United States Patent [19]

Covitch

[11] Patent Number: 4,465,533

[45] Date of Patent: Aug. 14, 1984

[54] METHOD FOR MAKING POLYMER BONDED ELECTRODES

[75] Inventor: Michael J. Covitch, Cleveland Heights, Ohio

[73] Assignee: ELTECH Systems Limited, Hamilton, Bermuda

[21] Appl. No.: 457,579

[22] Filed: Jan. 13, 1983

[51] Int. Cl.[3] ..... B32B 31/02; C25B 13/00

[52] U.S. Cl. ..... 156/83; 204/282; 204/292; 156/246; 156/249; 156/308.2; 264/104; 264/112; 264/127; 264/343

[58] Field of Search ..... 204/296, 290 R, 282, 204/292; 156/308.2, 83, 246, 249; 264/104, 112, 127, 343

[56] References Cited

U.S. PATENT DOCUMENTS

| | | | |
|---|---|---|---|
| 2,393,967 | 2/1946 | Brubaker | 260/80 |
| 2,559,752 | 7/1951 | Berry | 260/29.6 |
| 2,593,583 | 4/1952 | Lontz | 260/92.1 |
| 3,041,317 | 6/1962 | Gibbs et al. | 260/79.3 |
| 3,282,875 | 11/1966 | Connolly et al. | 524/795 |
| 3,297,484 | 1/1967 | Niedrach | 429/41 |
| 3,560,568 | 2/1971 | Resnick | 260/513 |
| 3,718,627 | 2/1973 | Grot | 260/79.3 |
| 3,925,135 | 12/1975 | Grot | 156/213 |
| 4,039,409 | 8/1977 | LaConti et al. | 204/129 |
| 4,056,452 | 11/1977 | Campbell | 204/258 |
| 4,057,479 | 11/1977 | Campbell | 204/258 |
| 4,090,931 | 4/1978 | Montani et al. | 204/98 |
| 4,144,301 | 3/1979 | Adams et al. | 264/126 |
| 4,151,053 | 4/1979 | Seko et al. | 204/98 |
| 4,196,070 | 4/1980 | Chao et al. | 204/266 |
| 4,212,714 | 7/1980 | Coker et al. | 204/98 |
| 4,214,958 | 7/1980 | Coker et al. | 204/98 |
| 4,349,422 | 9/1982 | Maloney | 204/98 |

FOREIGN PATENT DOCUMENTS

| | | |
|---|---|---|
| 2009788A | 6/1979 | United Kingdom . |
| 2009792A | 6/1979 | United Kingdom . |
| 2009795A | 6/1979 | United Kingdom . |
| 2069006A | 8/1981 | United Kingdom . |

*Primary Examiner*—John F. Niebling

*Attorney, Agent, or Firm*—Woodrow W. Ban; Arthur S. Collins

[57] ABSTRACT

A method for making polymer bonded electrode (PBE) structures wherein the particulate and particles of perfluorocarbon copolymer are combined with a solvent for the copolymer at a temperature where significant solvation of the perfluorocarbon does not occur. The resulting blended dispersion is spread to form the PBE, and the solvent removed. The PBE is then fused under heat and pressure for use.

12 Claims, 1 Drawing Figure

METHOD FOR MAKING POLYMER BONDED ELECTRODES

FIELD OF THE INVENTION

This invention relates to electrochemical cells and particularly to electrodes for use in such cells. More specifically, this invention relates to so called solid polymer electrodes or polymer bonded electrodes and to methods for their making.

BACKGROUND OF THE INVENTION

The basic structure of an electrochemical cell generally includes electrodes, an anode and a cathode arranged in opposition to one another within a compartment-like cell box. The cell box can contain one or more electrolytes, generally termed anolyte and catholyte depending upon which electrode happens to be in contact with the particular electrolyte.

Often for reasons of electrical efficiency, product purity, or other reasons, such cells will include a separator between the anode and cathode. The separator functions to separate the electrolytes, and may be either porous or non porous. Generally where the separator is non porous, such a separator will be possessed of ion exchange capability so that electrical current can be transferred between the electrodes through the separator. Conventionally, porous separators are termed diaphragms, and non porous separators are termed membranes.

Traditionally, electrodes within such cells have been configured as plate-like surfaces or plate-like mesh surfaces opposing one another to present a desirably large surface area in nearly direct (flow of electrical current being at right angles to the surfaces) opposition to at least one other electrode within the cell. Where such electrodes have been used with porous separators, it has often been necessary to space the electrode from the separator to avoid overvoltages associated with portions of the separator blinding surfaces of the electrode and thereby interfering with the releasing of gas bubbles being evolved at the electrode. Where such electrodes have been used with non porous separators, it has often been desirable to space the separator from the electrode to avoid mechanical damage to often fragile membranes. Such a spacing functions to increase the distance between electrodes within a cell, and thereby increases the electrical potential or voltage required to support cell operation. Operation at an elevated voltage increases the electrical power required to support cell operation placing such a cell operation at an economic disadvantage.

A number of proposals have been directed at improving the power consumption economics of electrochemical cells through decreases in the spacing between anode and cathode within an electrochemical cell. One such improvement has been the introduction of non porous membranes into such cells; generally such membranes can be operated at a closer anode cathode spacing than can diaphragms in the same cell. These membranes are frequently based upon a copolymeric perfluorocarbon material possessed of ion exchange capability. One copolymeric ion exchange material finding particular acceptance in electrochemical cells such as chlorine generation cells has been fluorocarbon vinyl ether copolymers known generally as perfluorocarbons and marketed by E. I. duPont under the name Nafion®.

These so-called perfluorocarbons are generally copolymers of two monomers with one monomer being selected from a group including vinyl fluoride, hexafluoropropylene, vinylidene fluoride, trifluoroethylene, chlorotrifluoroethylene, perfluoro(alkylvinyl ether), tetrafluoroethylene and mixtures thereof.

The second monomer is selected from a group of monomers usually containing an $SO_2F$, that is a sulfonyl fluoride group, or a group including or derived from COF, that is carbonyl fluoride. Examples of such second monomers can be generically represented by the formula $CF_2{=}CFR_1SO_2F$ or $CF_2{=}CFR_1COF$. $R_1$ in the generic formula is a bifunctional perfluorinated radical comprising generally 1 to 8 carbon atoms but occasionally as many as 25 carbon atoms. One restraint upon the generic formula is a general requirement for the presence of at least one fluorine atom on the carbon atom adjacent the $-SO_2F$ or COF, particularly where the functional group exists as the $-(-SO_2NH)_mQ$ form. In this form, Q can be hydrogen or an alkali or alkaline earth metal cation and m is the valence of Q. The $R_1$ generic formula portion can be of any suitable or conventional configuration, but it has been found preferably that the vinyl radical comonomer join the $R_1$ group through an ether linkage.

Typical sulfonyl fluoride containing monomers are set forth in U.S. Pat. Nos. 3,282,875; 3,041,317; 3,560,568; 3,718,627 and methods of preparation of intermediate perfluorocarbon copolymers are set forth in U.S. Pat. Nos. 3,041,317; 2,393,967; 2,559,752 and 2,593,583. These perfluorocarbons generally have pendant $SO_2F$ based functional groups. Typical methyl carboxylate containing monomers are set forth in U.S. Pat. No. 4,349,422.

Chlorine cells equipped with separators fabricated from perfluorocarbon copolymers have been utilized to produce a somewhat concentrated caustic product containing quite low residual salt levels. Perfluorocarbon copolymers containing perfluoro(3,6-dioxa-4-methyl-7-octenesulfonyl fluoride) comonomer and/or methyl carboxylate monomers such as perfluoro(4,7-dioxa-5-methyl-8 nonenoate) have found particular acceptance in $Cl_2$ cells.

In chlorine cells using a sodium chloride brine feedstock, one drawback to the use of perfluorocarbon separators having pendant sulfonyl fluoride based functional groups has been a relatively low resistance in desirably thin separators to back migration of caustic including $OH^-$ radicals from the cathode to the anode compartment. This back migration contributes to a lower current utilization efficiency in operating the cell since the $OH^-$ radicals react at the anode to produce oxygen. Recently, it has been found that if pendant sulfonyl fluoride based cationic exchange groups adjacent one separator surface were provided as pendant carboxylate groups, the back migration of $OH^-$ radicals in such $Cl_2$ cells would be significantly reduced. Conversion of sulfonyl fluoride groups to carboxylate groups is discussed in U.S. Pat. No. 4,151,053.

Presently, perfluorocarbon separators are generally fabricated by forming a thin membrane-like sheet under heat and pressure from one of the intermediate copolymers previously described. The ionic exchange capability of the copolymeric membrane is then activated by saponification with a suitable or conventional compound such as a strong caustic. Generally, such membranes are between 0.5 mil and 150 mil in thickness. Reinforced perfluorocarbon membranes have been fabricated, for example, as shown in U.S. Pat. No. 3,925,135 and 4,349,422.

Notwithstanding the use of such membrane separators, a remaining electrical power inefficiency in many batteries, fuel cells and electrochemical cells has been associated with a voltage drop between the cell anode and cathode attributable to passage of the electrical current through one or more electrolytes separating these electrodes, remotely positioned on opposite sides of the cell separator.

Recent proposals have physically sandwiched a perfluorocarbon membrane between an anode-cathode pair. The membrane in such sandwich cell construction functions as an electrolyte between the anode-cathode pair, and the term solid polymer electrolyte (SPE) cell has come to be associated with such cells, the membrane being a solid polymer electrolyte. In some of these SPE proposals, at least one of the electrodes has been a composite of a perfluorocarbon polymer such as Teflon®, E. I. duPont polytetrafluoroethylene (PTFE), with a finely divided electrocatalytic anode material or a finely divided cathode material. In others, the SPE is sandwiched between two such polymer containing electrodes. Typical sandwich SPE cells using non-polymer containing electrode are described in U.S. Pat. Nos. 4,144,301; 4,057,479; 4,056,452 and 4,039,409. SPE composite electrode cells including at least one polymer containing electrode are described in U.S. Pat. Nos. 3,297,484; 4,212,714 and 4,214,958 and in Great Britain Patent Application Nos. 2,009,788A; 2,009,792A and 2,009,795A.

Use of the composite electrodes can significantly enhance cell electrical power efficiency. However, drawbacks associated with present composite electrode configurations have complicated realization of full efficiency benefits. Composite electrodes generally are formed from blends of particulate PTFE and a metal particulate or particulate electrocatalytic compound. The PTFE blend is generally sintered into a decal-like patch that is then applied to a perfluorocarbon membrane. Heat and pressure are applied to the decal and membrane to obtain coadherence between them. A heating process generating heat sufficient to soften the PTFE for adherence to the sheet can present a risk of heat damage to cationic exchange properties of the membrane.

These PTFE based composites demonstrate significant hydrophobic properties that can inhibit the rate of transfer of cell chemistry through the composite to and from the electrically active component of the composite. Therefore, PTFE content of such electrodes must be limited. Formation of a porous composite has been proposed to ameliorate the generally hydrophobic nature of the PTFE composite electrodes, but simple porosity has not been sufficient to provide results potentially available when using a hydrophylic polymer in constructing the composite electrode.

It has been found, at least for use in chlor-alkali cells, that perfluorocarbon copolymer used for forming a membrane should be of an equivalent weight of between at least about 900 and about 1500 to provide a membrane with desirable performance characteristics. Membranes of lower equivalent weight have been found excessively susceptible to chlor alkali cell chemistry, while those of an equivalent weight beyond 1500 have been found insufficiently cation permeable to provide an attractive low resistance cell membrane. To date efforts to utilize a hydrophylic perfluorocarbon copolymer such as NAFION have been largely discouraged by difficulty in forming a commercially acceptable composite electrode utilizing these copolymeric materials. While presently composites are formed by sintering particles of PTFE until the particles coadhere, it has been found that similar sintering of perfluorocarbon copolymers having pendant cation exchange functional activity can significantly dilute the desirable cationic exchange performance characteristics of the copolymer in resulting composite electrodes.

An analogous difficulty has surfaced in the preparation of SPE sandwiches employing more conventional electrode structures. Generally these sandwich SPE electrode assemblies have been prepared by pressing a generally rectilinear electrode into one surface of a perfluorocarbon copolymeric membrane. In some instances, a second similar electrode is simultaneously or subsequently pressed into the obverse membrane surface. To avoid heat damage to the perfluorocarbon membrane, considerable pressure, often as high as 6000 psi is required to embed the electrode firmly in the membrane. Depending upon the configuration of the embedded electrode material, such pressure is often required to be applied simultaneously over the entire electrode area, requiring a press of considerable proportions when preparing a commercial scale SPE electrode.

Often where a foraminous electrode such as a mesh of titanium coated with a chlorine release electrocatalyst or a nickel mesh contacts a membrane in a cell, gases released at the electrode adhere to portions of the membrane causing a blinding effect thereby restricting cation passage therethrough. This restriction elevates the electrical voltage required for cell operation, and thereby effectively increases operational power costs.

The use of alcohols to solvate particularly low equivalent weight perfluorocarbon copolymers is known. However, as yet, proposals for formation of perfluorocarbon composite electrodes and for solvent welding the composites to perfluorocarbon membranes where the perfluorocarbons are of relatively elevated equivalent weights desirable in, for example, chlorine cells, have not proven satisfactory. Dissatisfaction has been at least partly due to a lack of suitable techniques for dispersing or solvating in part these higher equivalent weight perfluorocarbons.

Where efforts to solvate perfluorocarbon copolymer of desirably elevated equivalent weight has been moderately successful, and where the solvated perfluorocarbon copolymer has been used for forming an electrode including a particulate electrocatalyst, it has been found that the solvated perfluorocarbon can blind the electrocatalyst particles after formation of the electrode and reduce their catalytic activity. Since these electrocatalysts are often compounds of quite expensive metals such as the platinum group metals of ruthenium, iridium, osmium, palladium, rhodium, and platinum, blinding necessarily leads to the inclusion of additional compensatory quantities of the electrocatalyst in the electrode, an undesirable expense.

DISCLOSURE OF THE INVENTION

The present invention provides an improved polymer bonded electrode (PBE) and a method for making such PBE's. A PBE assembly made in accordance with the instant invention includes a cell separator or membrane and at least one polymer bonded electrode. The polymer bonded electrode of the instant invention is a composite of a copolymeric perfluorocarbon and a particulate substance often an electrocatalyst. The membrane and the copolymeric portion of any such polymer bonded electrode of PBE assembly are comprised principally of copolymeric perfluorocarbon having pendant cation exchange functional groups. The PBE and PBE assembly of the instant invention find particular use in electrochemical cells for the evolution of halogen gas from a brine of an alkali metal halide salt.

A PBE assembly made in accordance with the instant invention includes a perfluorocarbon copolymer based ion exchange separator or membrane and one or more polymer bonded electrodes coadhered to the membrane. Coadhered PBE's can include a particulate that is non electrocatalytic, thereby forming a composite solid polymer electrolyte (SPE). Alternatively, coardhered PBE's can include a relatively finely divided material having desired electrode and/or electrocatalytic properties. The PBE is a composite including a quantity of hydrophylic perfluorocarbon copolymeric material at least partially binding the electrode materials and other particulates.

A PBE having certain included particulates can provide enhanced gas release properties to a membrane chlor-alkali cell. When functioning as an electrode the PBE is a composite of a relatively finely divided conductive electrode material or substance and the copolymeric perfluorocarbon. Generally, if functioning as an anode, such a composite electrode will comprise the copolymeric perfluorocarbon and an electrocatalytic metal oxide such as an oxide of either a platinum group metal, antimony, tin, titanium, vanadium or mixtures thereof. Where functioning as a cathode, such as electrode can be comprised of a relatively finely divided material such as carbon, a group 8 metal, a group IB metal, a group IV metal, stainless steel and mixtures thereof.

In composite electrodes including finely divided metallics providing electrochemical reaction sites, it may be advantageous that pores be included generally throughout the composite to provide movement of cell electrochemical reactants to and from the reaction sites. It is desirable that finely divided metallics in such porous composites be only partially coated by the copolymeric perfluorocarbon, if in binding the particles they become coated at all.

PBE's and PBE assemblies of the instant invention are prepared by providing a perfluorocarbon copolymeric membrane and coadhering at least one PBE to the membrane. Where more than one membrane surface is to have a coadhered PBE, a composite PBE anode of a conductive anode material and copolymeric perfluorocarbon may be attached to one membrane surface, for example, and a composite PBE cathode of a conductive cathode material and copolymeric perfluorocarbon may be attached to the obverse membrane surface.

PBE composites can be prepared and coadhered to a selected membrane by any of several interrelated methods. For composites including relatively finely divided metallic materials, copolymeric perfluorocarbon is dispersed in a solvent, and the finely divided material is blended with the dispersion to form a blended dispersion and deposited upon a substrate. Solvent is removed, and the resulting composite is fused and coadhered to one surface of the membrane. Alternately the blended dispersion is applied directly upon one surface of the membrane in the form of a composite, and the solvent is removed. Solvent removal and coadherence of the composite to the membrane can be enhanced by the timely application of heat and pressure or by a leaching procedure involving a second substance in which the solvent is substantially miscible.

Dispersions are formed by blending quite finely divided particles of the perfluorocarbon copolymer and any other particulates to be dispersed into a solvent for the copolymeric perfluorocarbon. These particles should be of an average diameter of less than 100 microns, and preferably of an average diameter of less than 50 microns. The blending is accomplished at a temperature and in a ratio of solvent to perfluorocarbon copolymer such that substantial solvation of the particles does not occur. It is desired only that the particles be swelled by the solvent and not solvated.

Any other particulates can be added to the solvent. The perfluorocarbon copolymer may be added simutaneously, or subsequent to forming the blend, or for that matter may be added to the perfluorocarbon copolymer prior to contacting the perfluorocarbon copolymer with the solvent. It is desired that a ratio of copolymeric perfluorocarbon to particulate electrocatalyst or other particulate matter be maintained at not less than about 1:20 on a solventless weight basis.

The mixture of particulate material, solvent and perfluorocarbon copolymer forms a blended dispersion that has paste like qualities and can be spread using conventional paste techniques. This blended dispersion is deposited and the solvent removed using at least one of heat of room temperature or greater and vacuum. The resulting PBE is then fused by using at least one of heat in excess of about 100° C. and pressure in excess of about 100 pounds per square inch.

Where relatively finely divided metallic electrode material is employed in a composite, it may be preferred that the composite be rendered porous. Composite porosity can be attained by including a pore precursor in preparing the blended dispersion and then removing the pore precursor, such as by chemical leaching, after the solvent has been removed from the composite electrode. Alternatively, the porosity can be accomplished by depositing blended dispersion containing crystallized solvent droplets, subsequently removed.

The above and other features and advantages of the invention will become apparent from the following detailed description of the invention made with reference to the accompanying drawing which together form a part of the specification.

BEST MODE FOR CARRYING OUT THE INVENTION

Figure 1:
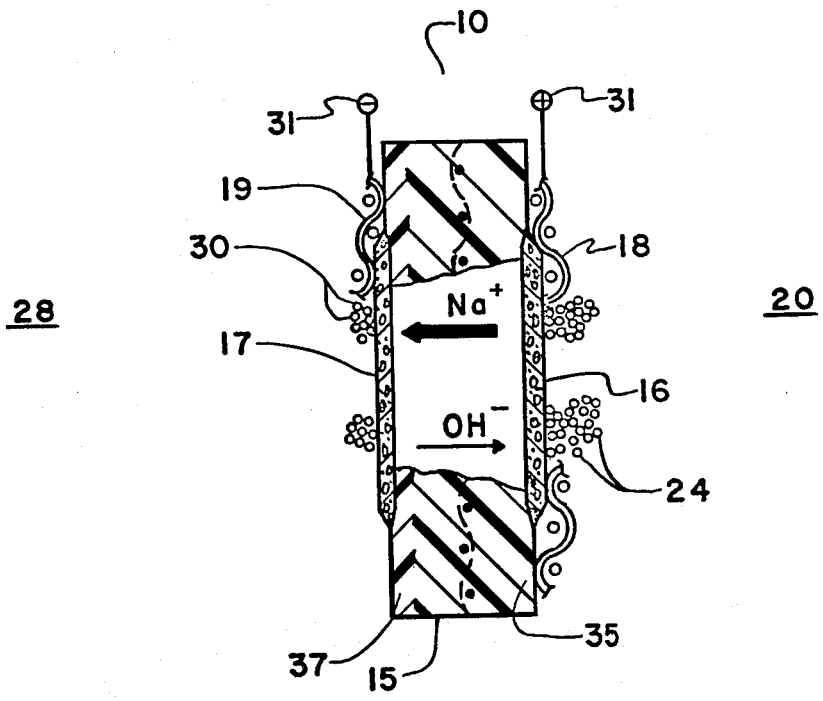
FIG. 1 is a side elevational cross-sectional view of a Polymer Bonded Electrode assembly shown in an environment typical of application to chlorine manufacture from sodium chloride brine.

Referring to FIG. 1, a polymer bonded electrode assembly is shown generally at 10. The PBE assembly 10 is comprised of a membrane or separator 15, composite PBE electrodes comprising an anode 16, and a cathode 17, and current collectors 18, 19.

The PBE assembly 10 functions within the confines of any suitable or conventional cell (not shown) to disassociate sodium chloride brine present in the cell generally at 20. The sodium chloride reacts generally at the anode 16 to release chlorine gas bubbles 24 which rise from the cell and are removed in any suitable or conventional manner well-known to those skilled in the art. Sodium ions released in the same reaction negotiate the separator 15 to carry electrical current between the anode and the cathode 17.

At the cathode, water present in the cell generally at 28 reacts to release hydrogen gas 30 and hydroxyl ions. These hydroxyl ions react with the sodium ions present at the cathode 17 to produce sodium hydroxide, or caustic. The caustic generally migrates to the cell area 28 while the hydrogen bubbles 30 rise from the cell and are recovered in any suitable or conventional manner. There is a tendency for caustic and/or hydroxyl ions to counter migrate from the cathode 17 to the anode 16 through the separator 15. Any hydroxyl ions reaching the anode tend to react to produce oxygen, and any such oxygen reaction decreases the overall electrical current efficiency in operation of the cell. A source 31 of electrical current impresses a current between the anode 16 and the cathode 17 motivating the cell reactions.

The generally sheet-like separator 15 is comprised principally of a copolymeric perfluorocarbon such as NAFION. The perfluorocarbon copolymer desirably should be available as an intermediate copolymer precursor which can be readily converted to a perfluorocarbon copolymer containing ion exchange sites. However, the perfluorocarbon often is more generally available in sheets already converted to provide active ion exchange sites. These sites on the final copolymer provide the ion exchange functional utility of the perfluorocarbon copolymer in the separator 15.

The intermediate copolymer is prepared from at least two monomers that include fluorine substituted sites. At least one of the monomers comes from a group that comprises vinyl fluoride, hexafluoropropylene, vinylidene fluoride, trifluoroethylene, chlorotrifluoroethylene, perfluoro(alkyl vinyl ether), tetrafluoroethylene and mixtures thereof.

At least one of the monomers comes from a grouping having members with functional groups capable of imparting cationic exchange characteristics to the final copolymer. Monomers containing pendant sulfonyl, carbonyl or, in some cases phosphoric acid based functional groups are typical examples. Condensation esters, amides or salts based upon the same functional groups can also be utilized. Additionally, these second group monomers can include a functional group into which an ion exchange group can be readily introduced and would thereby include oxyacids, salts, or condensation esters of carbon, nitrogen, silicon, phosphorus, sulfur, chlorine, arsenic, selenium, or tellurium.

Among the preferred families of monomers in the second grouping are sulfonyl or carbonyl containing monomers containing the precursor functional group $SO_2F$, $SO_3$ alkyl, COF, or $CO_2$ alkyl. Examples of members of such a family can be represented by the generic formulas of $CF_2{=}CFSO_2F$ and $CF_2{=}CFR_1SO_2F$ where $R_1$ is a bifunctional perfluorinated radical comprising usually 2 to 8 carbon atoms but reaching 25 carbon atoms upon occasion, and wherein the $SO_2F$ group can be replaced by a COF, $CO_2$ alkyl, and $SO_2$ alkyl.

The particular chemical content or structure of the perfluorinated radical linking the functional group to the copolymer chain is not critical but the carbon atom to which the functional group is attached must also have at least one attached fluorine atom. Preferably the monomers are perfluorinated. If the sulfonyl or carbonyl based group is attached directly to the chain, the carbon in the chain to which it is attached must have a fluorine atom attached to it. The $R_1$ radical of the formula above can be either branched or unbranched, i.e., straight chained, and can have one or more ether linkages. It is preferred that the vinyl radical in this group of sulfonyl fluoride or carbonyl fluoride containing comonomers by joined to the $R_1$ group through an ether linkage, illustratively, that the comonomer be of a formula typified by $CF_2{=}CFOR_1SO_2F$. Illustrative of such sulfonyl or carbonyl fluoride containing comonomers are:

$$CF_2{=}CFOCF_2CF_2SO_2F,\ CF_2{=}CFOCF_2\underset{\underset{CF_3}{|}}{C}FOCF_2CF_2SO_2F,$$

$$CF_2{=}CFOCF_2\underset{\underset{CF_3}{|}}{C}FOCF_2\underset{\underset{CF_3}{|}}{C}F_2SO_2F,\ CF_2{=}CFCF_2CF_2SO_2F,$$

$$\text{and } CF_2{=}CFOCF_2\underset{\underset{\underset{\underset{CF_3}{|}}{O}}{\underset{CF_2}{|}}}{C}FOCF_2CF_2SO_2F$$

for sulfonyl functionality, and $$CF_2{=}CFOCF_2CF_2COF,\ CF_2{=}CFOCF_2\underset{\underset{CF_3}{|}}{C}FOCF_2CF_2COF,$$

$$CF_2{=}CFOCF_2\underset{\underset{CF_3}{|}}{C}FOCF_2COF,$$

$$CF_2{=}CFOCF_2\underset{\underset{CF_3}{|}}{C}FOCF_2\underset{\underset{CF_3}{|}}{C}F_2COF,\ CF_2{=}CFCF_2CF_2COF,$$

$$\text{and } CF_2{=}CFOCF_2\underset{\underset{\underset{\underset{CF_3}{|}}{O}}{\underset{CF_2}{|}}}{C}FOCF_2CF_2COF$$

for carbonyl functionality.

The corresponding esters of the aforementioned sulfonyl or carbonyl fluorides are equally preferred.

While the preferred intermediate copolymers are perfluorocarbon, that is perfluorinated, others can be utilized where there is a fluorine atom attached to the carbon atom to which the functional group is attached. A highly preferred copolymer is one of tetrafluoroethylene and perfluoro(3,6-dioxa-4-methyl-7-octenesulfonyl fluoride) comprising between 10 and 60 weight percent, and preferably between 25 and 40 weight percent, of the latter monomers.

These perfluorinated copolymers may be prepared in any of a number of well-known manners such as is shown and described in U.S. Pat. Nos. 3,041,317; 2,393,967; 2,559,752 and 2,593,583.

An intermediate copolymer is readily transformed into a copolymer containing ion exchange sites by conversion of the functional groups (—$SO_2F$, COF, $CO_2$ alkyl, or —$SO_3$ alkyl) to the form —$SO_3Z$ or $CO_2Z$ by saponification or the like wherein Z is hydrogen, an alkali metal, a quaternary ammonium ion, or an alkaline earth metal. The converted copolymer contains sulfonyl or carbonyl group based ion exchange sites contained in side chains of the copolymer and attached to carbon atoms having at least one attached fluorine atom. Not all sulfonyl or carbonyl groups within the intermediate copolymer need be converted. The conversion may be accomplished in any suitable or customary manner such as is shown in U.S. Pat. Nos. 3,770,547 and 3,784,399.

A separator 15 made from copolymeric perfluorocarbon having sulfonyl based cation exchange functional groups possesses a relatively low resistance to back migration of sodium hydroxide from the cathode 17 to the anode 16, although such a membrane successfully resists back migration of other caustic compounds such as KOH. A pattern 32 of fluid circulation in the cell zone 28 adjacent the cathode contributes to a dilution in concentration of sodium hydroxide within and adjacent the cathode and adjacent the membrane, thus reducing a concentration gradient driving force tending to contribute to sodium hydroxide back migration.

In the best mode for carrying out the invention, the separator includes a zone 35 having copolymeric perfluorocarbon containing pendant sulfonyl based ion exchange functional groups and a second zone 37 having copolymeric perfluorocarbon containing pendant carbonyl based functional ion exchange groups. The pendant carbonyl based groups provide a copolymeric perfluorocarbon separator with significantly greater resistance to the backmigration of sodium hydroxide, but can also substantially reduce the rate of migration of sodium ions from the anode to the cathode. In order to present a relatively small additional resistance to the desired migration of sodium ions, the carbonyl based zone 37, usually is provided to be only of sufficient dimension to produce a signficant effect upon the back migration of sodium hydroxide.

Alternately zone 37 can include perfluorocarbon containing sulfonamide functionality of the form —$R_1$-$SO_2NHR_2$ where $R_2$ can be hydrogen, alkyl, substituted alkyl, aromatic or cyclic hydrocarbon. Methods for providing sulfonamide based ion exchange membranes are shown in U.S. Pat. No. 3,969,285 and 4,113,585.

Copolymeric perfluorocarbon having pendant carboxylate cationic exchange functional groups can be prepared in any suitable or conventional manner such as in accordance with U.S. Pat. No. 4,151,053 or Japanese Patent Application No. 52(1977)38486 or polymerized from a carbonyl functional group containing monomer derived from a sulfonyl group containing monomer by a method such as is shown in U.S. Pat. No. 4,151,053. Preferred carbonyl containing monomers include $CF_2{=}CF{-}O{-}CF_2CF(CF_3)O(CF_2)_2COOCH_3$ and $CF_2{=}CF{-}O{-}CF_2CF(CF_3)OCF_2COOCH_3$.

Preferred copolymeric perfluorocarbons utilized in the instant invention therefore include carbonyl and/or sulfonyl based groups represented by the formula —$OCF_2CF_2X$ and/or —$OCF_2CF_2Y{-}O{-}YCF_2CF_2O$— wherein X is sulfonyl fluoride ($SO_2F$) carbonyl fluoride (COF) sulfonate methyl ester ($SO_2OCH_3$) carboxylate methyl ester ($COOCH_3$) ionic carboxylate ($COO^-Z^+$) or ionic sulfonate ($SO_3^-Z^+$), Y is sulfonyl or carbonyl (—$SO_2$— —CO—) and Z is hydrogen, an alkali metal such as lithium, cesium, rubidium, potassium and sodium, an alkaline earth metal such as beryllium, magnesium, calcium strontium, barium and radium, or a quaternary ammonium ion.

Generally, sulfonyl, carbonyl, sulfonate and carboxylate esters and sulfonyl and carbonyl based amide forms of the perfluorocarbon copolymer are readily converted to a salt form by treatment with a strong alkali such as NaOH.

The zone 37, where used in a cell having foraminous electrodes in lieu of SPE electrodes, can contain a particulate such as an oxide of a valve metal. Particularly the oxides of titanium and zirconium have been found to aide in release of gases being evolved from the foraminous electrode from the surface of the zone, particularly where that foraminous electrode is situated in close proximity to the membrane or contacts the membrane directly. Gas release functions to "unblind" membrane surface, thus reducing restriction to the flow of cations through the membrane. The zone 37 thereby functions as a solid polymer electrolyte (SPE) between the electrode and the remaining membrane material, this SPE containing a non-electrolytic particulate. This zone can be formed by application to the membrane of a PBE-like structure made containing the valve metal oxide in lieu of an electrocatalyst.

A PBE or a PBE assembly is made in accordance with the instant invention by first providing a copolymeric perfluorocarbon membrane 15. The membrane 15 can include members of one or more of the ion exchange functional groups discussed previously, depending upon the nature of chemical reactants in the electrochemical cell. Blending of polymers containing different ion exchange functional groups is an available alternate. When chloride is to be generated from sodium chloride brine, it has been found advantageous to employ copolymer containing pendant sulfonyl based groups throughout most of the membrane and a similar copolymer, but containing pendant carbonyl based groups adjacent what is to be the cathode 17 facing membrane surface which can be attached as an SPE in accordance therewith.

The membrane 15 can be formed by any suitable or conventional means such as by extrusion, calendering, solution casting or the like. It may be advantageous to employ a reinforcing framework 40 within the copolymeric material. This framework can be of any suitable or conventional nature such as a PTFE mesh or the like. Layers of copolymer containing differing pendant functional groups can be laminated under heat and pressure in well-known processes to produce a membrane having desired functional group properties at each membrane surface. Alternately a bifunctional group membrane can be provided in accordance with solution forming techniques, absent any metal or catalyst particulates, of the invention. For chlorine cells, such membranes have a thickness generally of between 0.0254 mm and 3.810 mm with a preferable range of from 0.1016 mm to 0.254 mm.

The equivalent weight range of the copolymer intermediate used in preparing the membrane 15 as well as any PBE or PBE assembly is important. Where lower equivalent weight intermediate copolymers are utilized, the membrane can be subject to destructive attack such as by dissolution by cell chemistry. When an excessively elevated equivalent weight copolymer intermediate is utilized, the membrane may not pass cations sufficiently readily, resulting in an unacceptably high electrical resistance in operating the cell. It has been found that copolymer intermediate equivalent weights should preferably range between about 1000 and 1500 for the sulfonyl based membrane materials and between about 900 and 1500 for the carbonyl based membrane materials.

For a PBE, a particulate substance is selected for compositing with perfluorocarbon copolymers. When the resulting composite electrode is to be an anode, this substance will generally include elements or compounds having electrocatalytic properties. Particularly useful are oxides of either platinum group metals, antimony, tin, titanium, vanadium, cobalt or mixtures thereof. Also useful are platinum group metals, silver and gold. The platinum group includes platinum, palladium, rhodium, iridium, osmium, and ruthenium. Where the PBE is really to function not as an electrode, but rather as an SPE having entrained metal oxide particles to assist in gas release, or as an SPE simply having a differing chemical functional group pendant from the copolymeric perfluorocarbon than the functional groups typical of the perfluorocarbon copolymer forming the membrane to which the SPE is attached, then either a valve metal oxide, or alternately no particulate will be included in forming the PBE.

The electrocatalytic anode substance, and for that matter, any particulate included in a PBE made in accordance with this invention, is relatively finely divided, and where relatively finely divided, it may be combined with conductive extenders such as carbon or with relatively finely divided well-known valve metals such as titanium or their oxides. The valve metals, titanium, aluminum, zirconium, bismuth, tungsten, tantalum, niobium and mixtures and alloys thereof can also be used as the electrocatalyst while in their oxides or for assisting in gas release from a PBE surface.

When the composite PBE is to be a cathode, the active or conductive electrode substance is selected from a group comprising group IB metals, group IV metals, group 8 metals, carbon, any suitable or conventional stainless steel, the valve metals, platinum group metal oxides or mixtures thereof. Group IB metals are copper, silver and gold. Group IVA metals are tin and lead. Group 8 metals are iron, cobalt, nickel, and the platinum group metals. As with the anode, these active electrode substances should be finely divided.

Where the composite is to be an SPE having an entrained gas release particulate, the particulate is generally a valve metal oxide such as titanium or zirconium oxide or a suitable or conventional metallic gas release particulate such as oxides, hydroxides, nitrates, or carbides of Ti, Zn, Nb, Ta, V, Mn, Mo, Sn, Sb, W, Bi, In, Co, Ni, Be, Al, Cr, Fe, Ga, Ge, Se, Y, Ay, Hf, Pb, Si or Th.

By use of the term finely divided as applied to metal or metallic particulates what is meant is particles of a size of about 3.0 millimeters by 3.0 millimeters by 3.0 millimeters or smaller in at least one dimension. Preferably the particles are cragged in shape and have an average diameter of not more than 100 microns, those with diameters not in excess of 50 microns on the average finding great utility. In addition, particles having at least one dimension considerably larger than the other have been found effective such as particles having dimensions of 1.0 millimeter by 1.4 millimeters by 0.025 millimeters. Also useful are fibers having a diameter of between about 0.025 millimeter and about 1.0 millimeter and between about 1.0 millimeter and 50 millimeter in length in forming a composite PBE.

Perfluorocarbon copolymer is prepared for dispersion in solvent in a particular manner. The use of relatively finely divided particles of the copolymer is important in forming the dispersion. The particles are dispersed in a dispersion medium that must have significant capability for solvating the perfluorocarbon copolymer particles. A variety of solvents have been discovered for use as a dispersion solvent for the perfluorocarbon copolymer used in this invention; these suitable solvents are tabulated in Table I and coordinated with the copolymer pendant functional groups with which they have been found to be an effective solvent for forming blended dispersions for use in the invention. Since these dispersing solvents function effectively alone or in mixtures of more than one, the term dispersion media is used herein to indicate a suitable or conventional solvating dispersing agent including at least one solvent.

TABLE I

SOLVENT CROSS REFERENCE TO PERFLUOROCARBON COPOLYMER CONTAINING VARIOUS PENDANT FUNCTIONAL GROUPS

| SOLVENT | FUNCTIONAL GROUP | |
|---|---|---|
| | $COO^-Z^+$ | $SO_3^-Z^+$ |
| N—butylacetamide | X | X |
| tetrahydrothiophene-1,1-dioxide (tetramethylene sulfone, Sulfolane ®) | | X |
| N,N—dimethylacetamide | | X |
| N,N—diethylacetamide | | X |
| N,N—dimethylpropionamide | | X |
| N,N—dibutylformamide | | X |
| N,N—dipropylacetamide | | X |
| N,N—dimethylformamide | | X |

Z is an alkali or alkaline earth metal or a quaternary ammonium ion having attached hydrogen, alkyl, substituted alkyl, aromatic, or cyclic hydrocarbon.

Certain of the solvating dispersion media function more effectively with perfluorocarbon having particular metal ions associated with the functional group. For example, N-butylacetamide functions well with the groups COOLi and $SO_3Ca$. Sulfolane and N,N-dipropylacetamide function well with $SO_3Li$ functionality. It is believed that other suitable or conventional strongly polar compounds can be used for solvating the ionic sulfonate and carboxylate forms of perfluorocarbon copolymer.

A composite PBE is formed by blending the particulate materials with a mixture of the solvent and the copolymeric perfluorocarbon. The resulting blended dispersion is deposited, and the solvent is removed. After removal of the solvent, the resulting PBE is heated and/or pressed to fuse the the copolymeric perfluorocarbon. As a result, the electrocatalyst or other particulate matter is bound up by the perfluorocarbon into the desired PBE structure. Heat in excess of about 100° C. or pressure in excess of about 100 pounds per square inch is generally sufficient to fuse the PBE. Heat in excess of about 300° C. is undesirable as tending to detract from functionality of the perfluorocarbon copolymer.

In preparing the blended dispersion for making the PBE, regardless of the order in which the particulate copolymeric perfluorocarbon, the solvent and any particulate electrocatalytic material or other particulate materials are joined, it is important that the resulting blended dispersion not contain substantial quantities of solvated perfluorocarbon copolymer. The presence of solvated perfluorocarbon in the blended dispersion can coat the electrocatalyst or other particles with the perfluorocarbon copolymer in a manner that blinds the particles from performing their electrochemical or physical function within the PBE. It is necessary in making the PBE of the invention to use sufficient solvent only to swell the particles of perfluorocarbon copolymer without accomplishing significant solvation in order that the particles may be tacified and thereby coadhered during the fusing step.

A proper amount of solvent in the blended dispersion will render the blended dispersion spreadable using a conventional paste knife, but not flowable. One factor important in securing a blended dispersion having substantially no solvated perfluorocarbon copolymer is temperature. At more elevated temperature, the solvents of the invention are generally more aggressive, and will tend to solvate more copolymeric perfluorocarbon. It is therefore preferred that the temperature of the blended dispersion be kept below 100° C. and preferably below 50° C. The proper temperature will be partly a function of the specific solvent, the more aggressive the solvent, generally the lower the desired temperature. It is desirable that a temperature of 300° C. not be exceeded.

The nature of the copolymeric perfluorocarbon being swelled using the solvent also has a bearing upon the quantity of solvent used and the temperature at which the blended dispersion is maintained. Certain of the copolymeric perfluorocarbons, depending upon their pendant functional groups are naturally more thermoplastic than others. These more thermoplastic materials require less solvent inclusion to be swelled sufficiently for use in implementing the invention. Particularly amine sulfonate salts of the copolymeric perfluorocarbons tend to be more thermoplastic, while lithium salts of these copolymeric perfluorocarbons tend to be less thermoplastic.

Particles of perfluorocarbon copolymer suitable for use in implementing the invention can be prepared by cryogenic grinding. This grinding technique employs cryogenic liquified gases to cool the perfluorocarbon copolymer to a temperature at which it becomes brittle. The perfluorocarbon copolymer is then repeatedly shattered until reduced to a relatively uniform, desired particle size.

Alternately, the perfluorocarbon can be dissolved completely in a suitable solvent as shown in Table I, followed by introduction of a substance miscible in the solvent into the solution. Addition of the miscible material provokes precipitation of the copolymeric perfluorocarbon from solution and produces precipitate particles of a desirably small size. A typical example would be dissolution of the lithium sulfonate salt form of perfluorocarbon copolymer in SULFOLANE at 220° C. followed by cooling introduction of toluol into the solution to effect precipitation of particles averaging about 10 microns in diameter.

The following example is offered to further illustrate the invention.

EXAMPLE I

Nafion® brand 511 catalyst available from E. I. duPont having an equivalent weight of about 1100 was finely divided using cryogenic grinding procedures to yield a powder having an average particle size of about 10 microns. The perfluorocarbon copolymer Nafion® having $RSO_3K$ functionality was reacted with aqueous HCl (10 wt. %) to yield $2SO_3H$ functionality; further reaction with tributylamine yielded tributyl ammonium functionality. All reactions were at room temperature.

The perfluorocarbon particles now having tributyl ammonium functionality were combined with nickel powder (INCO 255) in a weight ratio of 4 parts nickel to one part copolymeric perfluorocarbon. Sufficient N,N-diethylacetamide was added to yield a spreadable paste.

The paste was applied to aluminum foil using a coating blade or knife, and the solvent was evaporated at 130° C in an vented oven utilizing forced air circulation. The resulting Polymer Bonded Electrode (PBE) was fused at 180° C. for one hour. The aluminum foil was removed from the PBE by soaking in caustic.

The PBE was then dried and applied to a membrane comprising 50% by weight of 1100 equivalent weight perfluorocarbon copolymer in the sulfonate resin form and 50% by weight of 1050 equivalent weight perfluorocarbon copolymer having pendant carboxylate based functional groups. Application was accomplished at 160° C. under 10,000 pounds per square inch of pressure. The resulting PBE assembly was installed into a chlor alkali bench scale cell and operated at 3.1 kiloamperes per square meter ($kA/m^2$) of membrane surface exposed to electrolyte in the cell at 80°-85° C. The PBE functioned as a cathode opposite a titanium mesh anode having a ruthenium and titanium oxide electrocatalytic coating applied thereto in well known fashion. A nickel reticulate structure functioned to collect electrical current from the PBE cathode.

The cell operated at 3.14 volts producing 28% by weight caustic at a 94% cathode current efficiency. An identical cell except absent the PBE and using the nickel reticulate as a cathode operated at 3.25 volts producing 28% caustic by weight at an 89% caustic current efficiency.

While a preferred embodiment of the invention has been shown and described in detail, it should be apparent that various modifications and alterations may be made thereto without departing from the scope of the claims that follow.

What is claimed is:

1. A method for the preparation of a polymer bonded electrode of a perfluorocarbon copolymer having an equivalent weight in excess of at least about 900, and not greater than about 1500, and a metallic substance in particulate form comprising the steps of:

finely dividing the copolymer to a particulate state having particles of an average particle dimension of not greater than 100 microns;

admixing the finely divided copolymer with a solvent for the copolymer in both a quantity and at a temperature whereby the copolymer particles are swelled but remain substantially unsolvated in the solvent, and with the particulate metallic substance in a ratio of not less than about a 1:20 ratio of copolymer and metallic substance on a solventless weight basis to form a blended dispersion;

depositing the blended dispersion upon a substrate;

removing the solvent and using at least one of heat and vacuum; and fusing the resulting polymer bonded electrode using at least one of heat in excess of 100° C. and pressure in excess of 100 pounds per square inch.

2. The method of claim 1 including the additional step of bonding the polymer bonded electrode to a membrane type cell separator using at lest one of heat in excess of 100° C. and pressure in excess of 1000 pounds per square inch.

3. The method of claim 1 wherein the blended dispersion is deposited upon a membrane type cell separator.

4. The method of claim 1, a particulate pore precursor being included in the blended dispersion and including the step of removing the pore precursor subsequent to removal of the solvent.

5. A method for the preparation of a polymer bonded electrode of a perfluorocarbon copolymer having pendant cation exchange functional groups selected from a group consisting of sulfonyl and carbonyl based groups and being in an equivalent weight range of in excess of at least about 900, and not greater than about 1500, and a metallic substance in finely divided particulate form comprising the steps of:

finely dividing the copolymer to a particulate state having particles of an average particle dimension of not greater than about 50 microns;

admixing the finely divided copolymer with both a solvent for the copolymer in a quantity and at a temperature whereby the copolymer particles are swelled but remain substantially unsolvated in the solvent and with the particulate metallic substances in not less than about a 1:20 ratio of copolymer and metallic substance on a solventless weight basis to form a blended dispersion;

depositing the blended dispersion upon a substrate;

removing the solvent using at least one of heat in excess of about 100° C. but not greater than about 300° C., and vacuum; and fusing the resulting polymer bonded electrode using at least one of heat in excess of 100° C. but not greater than about 300° C. and pressure in excess of 100 pounds per square inch.

6. The method of claim 5 including the additional step of removing the polymer bonded electrode from the substrate and bonding the polymer bonded electrode to a membrane type cell separator using at least one of heat in excess of 150° C. and pressure in excess of 1000 pounds per square inch.

7. The method of claim 5 wherein the blended dispersion is deposited upon a substrate comprising a membrane type cell separator.

8. The method of claim 5, a particulate pore precursor being included in the blended dispersion and including the step of removing the pore precursor subsequent to removal of the solvent.

9. The method of claim 5, the solvent being selected from a group consisting of N-butylacetamide, tetrahydrothiophene-1,1-dioxide, N-N-dimethylacetamide, N,N-diethylacetamide, N,N-dimethylpropionamide, N,N-dibutylformamide, N,N-dipropylacetamide, N-N-dimethylformamide and the pendant functional group of the copolymeric perfluorocarbon being selected from a group consisting of $COO^-Z^+$, COO(ester), and $SO_3^-Z^+$ wherein Z represents one of an alkali metal, alkaline earth metal and a quaternary ammonium ion having an attached hydrogen, alkyl, substituted alkyl, aromatic, or cyclic hydrocarbon.

10. The method of claim 6, the solvent being selected from a group consisting of N-butylacetamide, tetrahydrothiophene-1,1-dioxide, N-N-dimethylacetamide, N,N-diethylacetamide, N,N-dimethylpropionamide, N,N-dibutylformamide, N-N-dipropylacetamide, N-N-dimethylformamide and the pendant functional group of the copolymeric perfluorocarbon being selected from a group consisting of $COO^-Z^+$, COO(ester), and $SO_3^-Z^+$ wherein Z represents one of an alkali metal, alkaline earth metal and a quaternary ammonium ion having an attached hydrogen, alkyl, substituted alkyl, aromatic, or cyclic hydrocarbon.

11. The method of claim 7, the solvent being selected from a group consisting of N-butylacetamide, tetrahydrothiophene-1,1-dioxide, N-N-dimethylacetamide, N,N-diethylacetamide, N,N-dimethylpropionamide, N,N-dibutylformamide, N-N-dipropylacetamide, N-N-dimethylformamide and the pendant functional group of the the copolymeric perfluorocarbon being selected from a group consisting of $COO^-Z^+$, COO(ester), and $SO_3^-Z^+$ wherein Z represents one of an alkali metal, alkaline earth metal and a quaternary ammonium ion having an attached hydrogen, alkyl, substituted alkyl, aromatic, or cyclic hydrocarbon.

12. The method of claim 8, the solvent being selected from a group consisting of N-butylacetamide, tetrahydrothiophene-1,1-dioxide, N-N-dimethylacetamide, N,N-diethylacetamide, N,N-dimethylpropionamide, N,N-dibutylformamide, N-N-dipropylacetamide, N-N-dimethylformamide and the pendant functional group of the copolymeric perfluorocarbon being selected from a group consisting of $COO^-Z^+$, COO(ester), and $SO_3^-Z^+$ wherein Z represents one of an alkali metal, alkaline earth metal and a quaternary ammonium ion having an attached hydrogen, alkyl, substituted alkyl, aromatic, or cyclic hydrocarbon.

* * * * *